US010220638B2

(12) United States Patent
Katagami et al.

(10) Patent No.: US 10,220,638 B2
(45) Date of Patent: Mar. 5, 2019

(54) IMAGE FORMING APPARATUS AND IMAGE FORMING METHOD

(71) Applicant: SEIKO EPSON CORPORATION, Tokyo (JP)

(72) Inventors: Satoru Katagami, Matsumoto (JP); Kazuyoshi Tanase, Matsumoto (JP); Tsutomu Sasaki, Matsumoto (JP); Yuichi Washio, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/440,150

(22) Filed: Feb. 23, 2017

(65) Prior Publication Data

US 2017/0246885 A1 Aug. 31, 2017

(30) Foreign Application Priority Data

Feb. 25, 2016 (JP) ..... 2016-033923

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 2/2114
USPC ..... 347/21, 95, 96, 98, 100, 101
See application file for complete search history.

(56) References Cited

U.S. PATENT DOCUMENTS

2005/0110857 A1* 5/2005 Matsumoto ..... B41J 11/0015 347/104
2007/0064026 A1* 3/2007 Hirakawa ..... B41J 2/2114 347/6
2012/0320119 A1 12/2012 Sonehara
2014/0146104 A1 5/2014 Sonehara
2015/0174918 A1 6/2015 Tajima et al.

FOREIGN PATENT DOCUMENTS

JP 2013-000997 A 1/2013
JP 2015-116797 A 6/2015
JP 2015-134460 A 7/2015

* cited by examiner

*Primary Examiner* — Jannelle M Lebron
(74) *Attorney, Agent, or Firm* — Workman Nydegger

(57) ABSTRACT

An image forming apparatus includes a reaction liquid application portion that applies reaction liquid to a recording medium, an ink application portion that applies ink which includes a color material that is coagulated using the reaction liquid onto the recording medium onto which the reaction liquid is applied, and a control portion that adjusts an amount per unit area of the reaction liquid that is applied to the recording medium from the reaction liquid application portion according to infiltration into the recording medium.

8 Claims, 8 Drawing Sheets

FIG. 6

CONFIRMATION RESULT OF IMAGE DEFECT DUE TO TOO LITTLE REACTION LIQUID

| | SHEET A (MINIMAL INFILTRATION) | | | SHEET G (MEDIUM INFILTRATION) | | | SHEET M (MAXIMUM INFILTRATION) | | |
|---|---|---|---|---|---|---|---|---|---|
| T(s)⇒ | 0.35 | 0.7 | 1.4 | 0.35 | 0.7 | 1.4 | 0.35 | 0.7 | 1.4 |
| REACTION LIQUID 20% | ○ | △ | × | × | × | × | × | × | × |
| REACTION LIQUID 40% | ○ | ○ | ○ | ○ | △ | △ | ○ | △ | × |
| REACTION LIQUID 60% | ○ | ○ | ○ | ○ | ○ | ○ | ○ | × | × |
| REACTION LIQUID 80% | ○ | ○ | ○ | ○ | ○ | ○ | ○ | ○ | ○ |

CONFIRMATION RESULT OF IMAGE DEFECT DUE TO TOO MUCH REACTION LIQUID

| | SHEET A (MINIMAL INFILTRATION) | | | SHEET G (MEDIUM INFILTRATION) | | | SHEET M (MAXIMUM INFILTRATION) | | |
|---|---|---|---|---|---|---|---|---|---|
| T(s)⇒ | 0.35 | 0.7 | 1.4 | 0.35 | 0.7 | 1.4 | 0.35 | 0.7 | 1.4 |
| REACTION LIQUID 20% | △ | ○ | ○ | ○ | ○ | ○ | ○ | ○ | ○ |
| REACTION LIQUID 40% | × | △ | ○ | ○ | ○ | ○ | ○ | ○ | ○ |
| REACTION LIQUID 60% | × | × | △ | × | ○ | ○ | ○ | ○ | ○ |
| REACTION LIQUID 80% | × | × | × | × | ○ | ○ | ○ | ○ | ○ |

COMBINED RESULT

| | SHEET A (MINIMAL INFILTRATION) | | | SHEET G (MEDIUM INFILTRATION) | | | SHEET M (MAXIMUM INFILTRATION) | | |
|---|---|---|---|---|---|---|---|---|---|
| T(s)⇒ | 0.35 | 0.7 | 1.4 | 0.35 | 0.7 | 1.4 | 0.35 | 0.7 | 1.4 |
| REACTION LIQUID 20% | ○/△ | △/○ | ×/○ | ×/○ | ×/○ | ×/○ | ×/○ | ×/○ | ×/○ |
| REACTION LIQUID 40% | ○/× | ○/△ | ○/○ | ○/○ | △/○ | △/○ | ○/○ | △/○ | ×/○ |
| REACTION LIQUID 60% | ○/× | ○/× | ○/△ | ○/× | ○/○ | ○/○ | ○/○ | ×/○ | ×/○ |
| REACTION LIQUID 80% | ○/× | ○/× | ○/× | ○/× | ○/○ | ○/○ | ○/○ | ○/○ | ○/○ |

IMAGE FORMING APPARATUS AND IMAGE FORMING METHOD

BACKGROUND

1. Technical Field

The present invention relates to a technique in which an image is formed by applying reaction liquid onto a recording medium then applying ink, which includes color material that is coagulated using the reaction liquid, onto the recording medium.

2. Related Art

A recording apparatus (image forming apparatus) in JP-A-2015-116797 discharges reaction liquid, in which color material included in ink is coagulated, onto a recording medium and then discharges ink onto the recording medium. The printing apparatus is able to coagulate color material of ink that is discharged onto the recording medium using the reaction liquid and quickly fix the color material of ink onto the recording medium.

Note that, in such an image forming apparatus, an amount of the reaction liquid that is applied to the recording medium is important. That is, when the reaction liquid on the recording medium front surface is too little, bleeding may occur in the image without reaction sufficiently occurring. Conversely, when the reaction liquid is too great on the recording medium front surface, blurring may occur on the image without a liquid droplet of ink sufficiently spreading out by a film of the reaction liquid being generated around the liquid droplet of ink that is landed on the recording medium. Alternatively, ink that is positioned at an end may be pulled to the center and an indentation may be generated on an end of the image due to convection that occurs by a process in which excess moisture evaporates.

Therefore, an amount of the reaction liquid that remains on a front surface of the recording medium when ink is applied to the recording medium greatly influences quality of the image. However, since infiltration is different according to the recording medium, in a recording medium with high infiltration, the reaction liquid does not sufficiently remain on the front surface of the recording medium, and in contrast, in the recording medium with low infiltration, the reaction liquid excessively remains on the front surface of the recording medium. As a result, it may be difficult to form an image with favorable quality.

SUMMARY

An advantage of some aspects of the invention is to provide a technique in which it is possible for the reaction liquid of an appropriate amount to remain on the front surface of the recording medium when ink is applied to the recording medium.

The invention can be realized in the following aspects.

According to an aspect of the invention, there is provided an image forming apparatus including a reaction liquid application portion that applies reaction liquid to a recording medium, an ink application portion that applies ink which includes a color material that is coagulated using the reaction liquid onto the recording medium onto which the reaction liquid is applied, and a control portion that adjusts an amount per unit area of the reaction liquid that is applied to the recording medium from the reaction liquid application portion according to infiltration into the recording medium.

According to another aspect of the invention, there is provided an image forming method including applying reaction liquid to a recording medium, and applying ink which includes a color material that is coagulated using the reaction liquid onto the recording medium onto which the reaction liquid is applied, in which an amount per unit area of the reaction liquid that is applied to the recording medium is adjusted according to infiltration into the recording medium.

In the aspects of the invention configured in the manner above, the amount per unit area of the reaction liquid that is applied to the recording medium is adjusted according to the infiltration into the recording medium. As a result, it is possible for the reaction liquid of an appropriate amount to remain on the front surface of the recording medium when the ink is applied to the recording medium.

In detail, since the higher the infiltration into the recording medium, the faster the reaction liquid that is applied to the recording medium infiltrates inside from the front surface of the recording medium, reduction of the reaction liquid that remains on the front surface of the recording medium speeds up. Therefore, the control portion may be configured such that the amount per unit area of the reaction liquid that is applied to the recording medium from the reaction liquid application portion is raised the higher the infiltration into the recording medium. Due to this, it is possible for the reaction liquid of an appropriate amount to remain on the front surface of the recording medium when the ink is applied to the recording medium.

In addition, there may be a configuration in which a driving portion is provided that relatively moves the reaction liquid application portion and the ink application portion in a predetermined direction with respect to the recording medium, in which the reaction liquid application portion applies the reaction liquid to the recording medium by discharging the reaction liquid while relatively moving in the predetermined direction with respect to the recording medium, the ink application portion applies the ink onto the recording medium on which the reaction liquid is applied by the reaction liquid application portion by discharging the ink while relatively moving in the predetermined direction with respect to the recording medium at an upstream side in a predetermined direction with respect to the reaction liquid application portion, and the control portion adjusts velocity at which the reaction liquid application portion and the ink application portion are relatively moved with respect to the recording medium according to the infiltration into the recording medium.

With this configuration, the reaction liquid is discharged onto the recording medium while the reaction liquid application portion relatively moves in the predetermined direction with respect to the recording medium, and the ink is discharged onto the recording medium while the ink application portion relatively moves in the predetermined direction with respect to the recording medium with a form of following the reaction liquid application portion. Due to this, ink is applied to the recording medium onto which the reaction liquid is applied. At this time, a time is changed from the reaction liquid being applied to the recording medium until the ink is applied according to the velocity at which the reaction liquid application portion and the ink application portion relatively move, and the amount of the reaction liquid that remains on the recording medium is also changed when the ink is applied. Therefore, with this configuration, velocity at which the reaction liquid application portion and the ink application portion relatively move with respect to the recording medium is adjusted according to the infiltration into the recording medium. As a result, it is reliably possible for the reaction liquid of an appropriate amount to remain on the front surface of the recording medium when the ink is applied to the recording medium.

In detail, since the higher the infiltration into the recording medium, the faster the reaction liquid that is applied to the recording medium infiltrates inside from the front surface of the recording medium, reduction of the reaction liquid that remains on the front surface of the recording medium speeds up. Therefore, the control portion may be configured such that velocity at which the reaction liquid application portion and the ink application portion relatively move with respect to the recording medium is raised the higher the infiltration into the recording medium. Due to this, it is possible for the reaction liquid of an appropriate amount to remain on the front surface of the recording medium when the ink is applied to the recording medium.

At this time, it is possible to configure such that the driving section moves a carriage that holds the reaction liquid application portion and the ink application portion in a predetermined direction, and the control portion adjusts velocity at which the carriage moves in the predetermined direction according to the infiltration into the recording medium. Alternatively, it is possible to configure such that the driving section moves the recording medium in a reverse direction to the predetermined direction, and the control portion adjusts velocity at which the recording medium moves in the reverse direction according to the infiltration into the recording medium.

In addition, the image forming apparatus may be configured so as to be provided with a drying portion that dries the recording medium on which the reaction liquid is applied from the reaction liquid being applied by the reaction liquid application portion until the ink is applied by the ink application portion, in which the control portion adjusts drying performance of the drying portion according to the infiltration into the recording medium. With this configuration, drying performance is adjusted according to the infiltration into the recording medium when the recording medium is dried from the reaction liquid being applied until the ink is applied. As a result, it is more reliably possible for the reaction liquid of an appropriate amount to remain on the front surface of the recording medium when the ink is applied to the recording medium.

In detail, since the higher the infiltration into the recording medium, the faster the reaction liquid that is applied to the recording medium infiltrates inside from the front surface of the recording medium, reduction of the reaction liquid that remains on the front surface of the recording medium speeds up. Therefore, the control portion may be configured such that the drying performance of the drying portion is lowered the higher the infiltration into the recording medium. Due to this, it is possible for the reaction liquid of an appropriate amount to remain on the front surface of the recording medium when the ink is applied to the recording medium.

According to still another aspect of the invention, there is provided an image forming apparatus including a reaction liquid application portion that discharges reaction liquid, an ink application portion that discharges ink which includes a color material that is coagulated using the reaction liquid, a driving portion that relatively moves the reaction liquid application portion and the ink application portion in a predetermined direction with respect to the recording medium, and a control portion that controls the driving portion, in which the reaction liquid application portion applies the reaction liquid to the recording medium by discharging the reaction liquid while relatively moving in the predetermined direction with respect to a recording medium, the ink application portion applies the ink onto the recording medium on which the reaction liquid is applied by the reaction liquid application portion by discharging the ink while relatively moving in a predetermined direction with respect to the recording medium at an upstream side in the predetermined direction with respect to the reaction liquid application portion, and the control portion adjusts velocity at which the reaction liquid application portion and the ink application portion are relatively moved with respect to the recording medium according to infiltration into the recording medium.

According to still another aspect of the invention, there is provided an image forming method including starting relative movement of a reaction liquid application portion that discharges reaction liquid and an ink application portion that discharges ink in a predetermined direction with respect to a recording medium, applying the reaction liquid onto the recording medium by discharging the reaction liquid from the reaction liquid application portion, and applying ink onto the recording medium onto which the reaction liquid is applied by discharging the ink from the ink application portion on the upstream side in a predetermined direction with respect to the reaction liquid application portion, in which velocity at which the reaction liquid application portion and the ink application portion are relatively moved with respect to the recording medium is adjusted according to infiltration into the recording medium.

In the aspect of the invention configured in the manner above, the reaction liquid is discharged onto the recording medium while the reaction liquid application portion relatively moves in the predetermined direction with respect to the recording medium, and the ink is discharged onto the recording medium while the ink application portion relatively moves in the predetermined direction with respect to the recording medium with a form of following the reaction liquid application portion. Due to this, the ink is applied to the recording medium onto which the reaction liquid is applied. At this time, a time is changed from the reaction liquid being applied to the recording medium until the ink is applied according to the velocity at which the reaction liquid application portion and the ink application portion relatively move, and the amount of the reaction liquid that remains on the recording medium is also changed when the ink is applied. Therefore, with this configuration, velocity at which the reaction liquid application portion and the ink application portion relatively move with respect to the recording medium is adjusted according to the infiltration into the recording medium. As a result, it is reliably possible for the reaction liquid of an appropriate amount to remain on the front surface of the recording medium when the ink is applied to the recording medium.

According to still another aspect of the invention, there is provided an image forming apparatus including a reaction liquid application portion that applies reaction liquid to a recording medium, an ink application portion that applies ink which includes a color material that is coagulated using the reaction liquid onto the recording medium onto which the reaction liquid is applied, a drying portion that dries the recording medium on which the reaction liquid is applied from the reaction liquid being applied by the reaction liquid application portion until the ink is applied by the ink application portion, and a control portion that adjusts drying performance of the drying portion according to infiltration into the recording medium.

According to still another aspect of the invention, there is provided an image forming method including applying reaction liquid to a recording medium, drying the recording medium onto which the reaction liquid is applied, and applying ink which includes a color material that is coagulated using the reaction liquid onto the recording medium on which drying is performed after the reaction liquid is applied, in which drying performance when the recording medium is dried is adjusted according to infiltration into the recording medium.

In the aspects of the invention configured in the manner above, the drying performance when the recording medium is dried from the reaction liquid being applied until ink is applied is adjusted according to the infiltration into the recording medium. As a result, it is more reliably possible for the reaction liquid of an appropriate amount to remain on the front surface of the recording medium when the ink is applied to the recording medium.

Note that, since not all of a plurality of configuring elements that each aspect of the invention described above has are essential and in order to solve a part or all of the problems described above, or in order to achieve a part or all of the effects described in the specification, as appropriate, modification, deletion, replacement with a new other configuring element, and partial deletion of limited content, of a part of the configuring elements of the plurality of configuring elements, may be performed. In addition, in order to solve a part or all of the problems described above, or in order to achieve a part or all of the effects described in the specification, the independent inventions may be formed as one by combining a part or all of technical characteristics that are included in one form of the invention described above and a part or all of the technical characteristics which are included in another form of the invention described above.

BRIEF DESCRIPTION OF THE DRAWINGS

The invention will be described with reference to the accompanying drawings, wherein like numbers reference like elements.

FIG. 6 is a diagram illustrating an experimental result of a relationship between time from a reaction liquid discharge until ink discharge and image defects.

DESCRIPTION OF EXEMPLARY EMBODIMENTS

Figure 1:
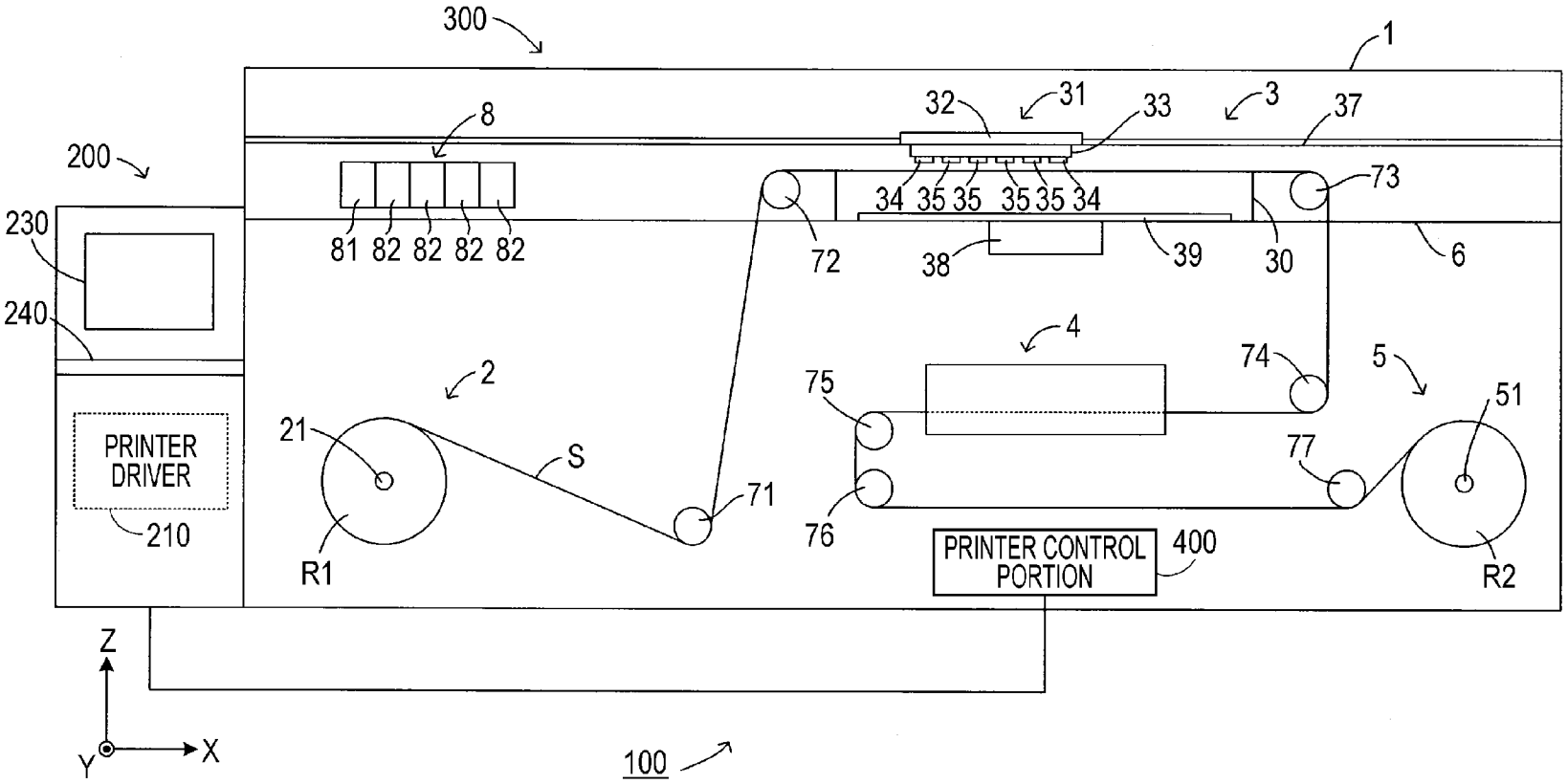
FIG. 1 is a front surface view illustrating a printing system that is provided with a printer to which the invention is applied.

FIG. 1 is a front surface view schematically illustrating an example of a printing system that is provided with a printer that applies the invention. Note that, XYZ orthogonal coordinates are described together where the Z axis is a vertical axis in order to clarify a disposition relationship of each portion of the apparatus according to need using FIG. 1 and the subsequent drawings. In addition, in the description below, a positive direction that is a direction in which (arrows of) each coordinate axis faces and a negative direction that is an opposite direction thereto are appropriately handled.

A printing system 100 is provided with a host device 200 that generates printing data from image data (heat map data) which is received from an external device such as a personal computer and a printer 300 that prints an image based on the printing data which is received from the host device 200. The printer 300 prints the image on a front surface of a long sheet S using an ink jet method while transporting the sheet S roll-to-roll.

As shown in FIG. 1, the printer 300 is provided with a main body casing 1 that has a substantially rectangular shape. A feeding portion 2 that feeds the sheet S from a roll R1 on which the sheet S is wound, a printing chamber 3 that performs printing by discharging ink onto the front surface of the wound sheet S, a drying portion 4 that dries the sheet S onto which ink is adhered, and a winding portion 5 that winds the sheet S after drying as a roll R2 are disposed inside the main body casing 1.

In further detail, the inside of the main body casing 1 is partitioned vertically in a Z axis direction using a flat plate form base 6 which is disposed parallel to (that is, horizontal to) the XY horizontal plane, and an upper side of the base 6 is set as the printing chamber 3. In a substantially center portion within the printing chamber 3, a platen 30 is fixed to the upper surface of the base 6. The platen 30 has a rectangular shape, and the sheet S is supported from the lower side using the upper surface parallel to the XY horizontal plane. Then, printing is perform by a recording unit 31 with respect to the front surface of the sheet S that is supported on the platen 30.

Meanwhile, the feeding portion 2, the drying portion 4, and the winding portion 5 are disposed on the lower side of the base 6. The feeding portion 2 is disposed on the lower side (obliquely down leftward in FIG. 1) in the X axis negative direction with respect to the platen 30, and is provided with a rotatable feeding shaft 21. Then, the roll R1 is supported by the sheet S being wound on the feeding shaft 21. Meanwhile, the winding portion 5 is disposed on the lower side (obliquely down rightward in FIG. 1) in the X axis positive direction with respect to the platen 30, and is provided with a rotatable winding shaft 51. Then, the roll R2 is supported by the sheet S being wound on the winding shaft 51. In addition, the drying portion 4 is disposed directly below the platen 30 between the feeding portion 2 and the winding portion 5 in the X axis direction.

Then, the sheet S that is feed from the feeding shaft 21 of the feeding portion 2 is wound on the winding shaft 51 of the winding portion 5 after passing through the printing chamber 3 and the drying portion 4 in order while being guided by rollers 71 to 77. That is, the rollers 72 and 73 are disposed lined up (that is horizontally) straight in the X axis direction so as to interpose the platen 30, and the respective top portions are positionally adjusted so as to have the same height as the upper surface (surface which supports the sheet S) of the platen 30. Accordingly, the sheet S that is wound on the roller 72 is moved horizontally (X axis direction) while in sliding contact with the upper surface of the platen 30 up to reaching the roller 73.

In the printing chamber 3, the printing process on the sheet S is executed by the recording unit 31 that is disposed on the upper surface of the platen 30. The recording unit 31 prints the image on the front surface of the sheet S by discharging ink on the front surface of the sheet S after reaction liquid is discharged on the front surface of the sheet S. That is, a cartridge mounting portion 8 is provided on an end portion (left end portion in FIG. 1) in the X axis negative direction within the printing chamber 3, and a reaction liquid cartridge 81 which retains the reaction liquid and a plurality of ink cartridges 82 which retain ink of colors that are different from each other are mounted in the cartridge mounting portion 8 to be attachable and detachable. Then, the recording unit 31 is able to discharge the reaction liquid that is supplied from the reaction liquid cartridge 81 and ink that is supplied from the ink cartridge 82 on the front surface of the sheet S by respective ink jet methods.

That is, in the reaction liquid, a coagulant, which coagulates a color material that is included in ink, is dissolved in a solvent. It is possible to suitably use a multivalent metal salt as the coagulant. It is possible to suitably use one or a plurality out of, for example, calcium nitrate, calcium chloride, magnesium chloride, calcium acetate, magnesium acetate, and calcium formate as the multivalent metal salt. In addition, it is preferable to use water as the solvent of the reaction liquid, a water-soluble organic solvent such as a polyhydric alcohol and a polyhydric alcohol derivative may be added in addition to the water.

Figure 2:
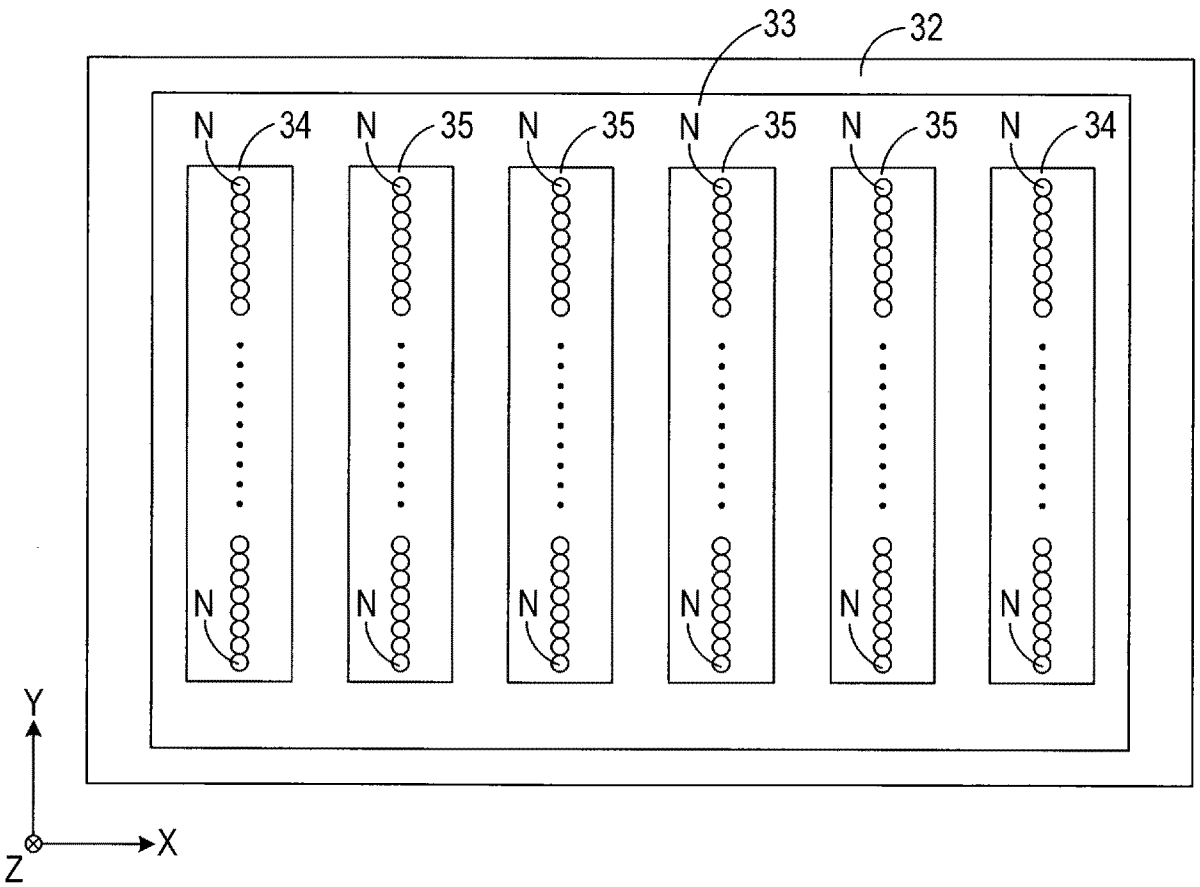
FIG. 2 is a bottom surface view partially illustrating a configuration of a recording unit.

FIG. 2 is a bottom surface view partially illustrating a configuration of a recording unit. Here, details of the recording unit 31 will be described using FIGS. 1 and 2. The recording unit 31 has a carriage 32, a flat plate form support plate 33 that is attached to the lower surface of the carriage 32, and recording heads 34 and 35 that are attached to the lower surface of the support plate 33. On the lower surface of the support plate 33, one recording head 34, four recording heads 35, and one recording head 34 are lined up at an equal pitch in the X axis direction and a plurality of nozzles N are lined up parallel to the Y axis direction in each recording head 34 and 35. Then, the respective recording heads 34 on both ends discharge the reaction liquid from the nozzles N, and the four recording heads 35 that are disposed between the recording heads 34 respectively discharge ink of colors that are different from each other from the nozzles N.

The description will continue returning to FIG. 1. The carriage 32 of the recording unit 31 that is configured as described above is integrally movable with the support plate 33, and the recording heads 34 and 35. That is, inside the printing chamber 3, when an X axis guide rail 37 is provided to extend parallel to the X axis direction and the carriage 32 receives driving force of an X axis motor Mx (FIG. 3), the carriage 32 moves in the X axis direction along the X axis guide rail 37. Furthermore, inside the printing chamber 3, when a Y axis guide rail (omitted in the illustration) is provided to extend parallel to the Y axis direction and the carriage 32 receives driving force of a Y axis motor My (FIG. 3), the carriage 32 moves in the Y axis direction along the Y axis guide rail.

Then, printing is executed by a lateral scan method described, for example, in JP-A-2013-000997 and the like. According to the method, printing is executed by two-dimensionally moving the carriage 32 of the recording unit 31 in the XY surface with respect to the sheet S that stops on the upper surface of the platen 30. In detail, the recording unit 31 executes an operation (main scanning) in which ink is discharged on the front surface of the sheet S from each nozzle N of the recording heads 35 while moving the carriage 32 in the X axis direction (main scanning direction). In the main scanning, a two dimensional image is printed by lining up a plurality of images per one line (line images) that extend in the X axis direction which is formed by ink that is discharged by one nozzle N while spacing at intervals in the Y axis direction. Then, main scanning of a plurality of times is executed by alternately executing the main scanning and sub-scanning in which the carriage 32 is moved in the Y axis direction (sub-scanning direction).

That is, when the recording unit 31 completes main scanning of one time, the recording unit 31 moves the carriage 32 in the Y axis direction by performing sub-scanning. Subsequently, the recording unit 31 moves the carriage 32 in the X axis direction (opposite orientation to the main scanning of a tip) from a position that is moved by sub-scanning. Due to this, the line image is formed by new main scanning between each of the plurality of line images which are formed already by the main scanning of the tip. Then, the printer 300 executes the main scanning a plurality of times while reciprocally moving the carriage 32 and prints the image per one frame by alternately executing the main scanning and the sub-scanning.

In particular, in each main scan of the embodiment, the reaction liquid is discharged from the recording heads 34 that are positioned at a head of the carriage 32 in the movement direction. That is, the recording heads 34 discharge the reaction liquid with respect to a prearranged range in which ink is discharged by each recording head 35 on the upstream side in the movement direction in the main scanning during execution. Accordingly, the color material of ink in each line image that is printed in the main scanning is fixed to the front surface of the sheet S by coagulating by the action of the reaction liquid that is discharged in advance on the front surface of the sheet S.

Printing of one frame as described above is repeatedly executed while intermittently moving the sheet S in the X axis direction. In detail, the predetermined range across substantially the entire region of the platen 30 on the upper surface is a printing region. Then, printing of one frame is performed on the sheet S that is stopped on the upper surface of the platen 30 during intermittent transport while the sheet S is intermittently transported in the X axis direction with a distance (intermittent transport distance) that corresponds to length of the printing region in the X axis direction as a unit. In other words, when printing of one frame ends on the sheet S that stops on the platen 30, the sheet S is transported in the X axis direction by the intermittent transport distance and an unprinted surface of the sheet S stops on the platen 30. Subsequently, printing of one frame is newly executed on the unprinted surface, and when printing ends, the sheet S is transported again in the X axis direction by the intermittent transport distance. Then, the series of operations are repeatedly executed.

Note that, since the sheet S that stops on the upper surface of the platen 30 during intermittent transport is kept flat, the platen 30 is provided with a mechanism that suctions the sheet S that stops on the upper surface. In detail, multiple suction holes which are not shown in the drawings are open on the upper surface of the platen 30, and a suction portion 38 is attached to the lower surface of the platen 30. Then, by the suction portion 38 operating, negative pressure is generated in the suction hole on the upper surface of the platen 30 and the sheet S is suctioned on the upper surface of the platen 30. Then, while the sheet S for printing is stopped on the platen 30, the sheet S is kept flat by the suction portion 38 suctioning the sheet S. Meanwhile, when printing ends, it is possible to smoothly transport the sheet S by the suction portion 38 stopping the suction of the sheet S.

Furthermore, a heater 39 is attached on the lower surface of the platen 30. The heater 39 heats the platen 30 at a predetermined temperature (for example, 45 degrees). Thereby, the sheet S is primarily dried by heat of the platen 30 while receiving the printing process using the recording heads 34 and 35. Then, drying of the reaction liquid or ink that is landed on the sheet S is promoted by the primary drying.

By doing this, the sheet S that is primarily dried while receiving printing of one frame moves from the platen 30 to the drying portion 4 accompanying intermittent transport of the sheet S. The drying portion 4 executes the drying process in which the reaction liquid or ink that is landed on the sheet S is completely dried by air that is heated using drying. Then, the sheet S that receives the drying process reaches the winding portion 5 accompanying intermittent transport of the sheet S and is wound as the roll R2.

Figure 3:
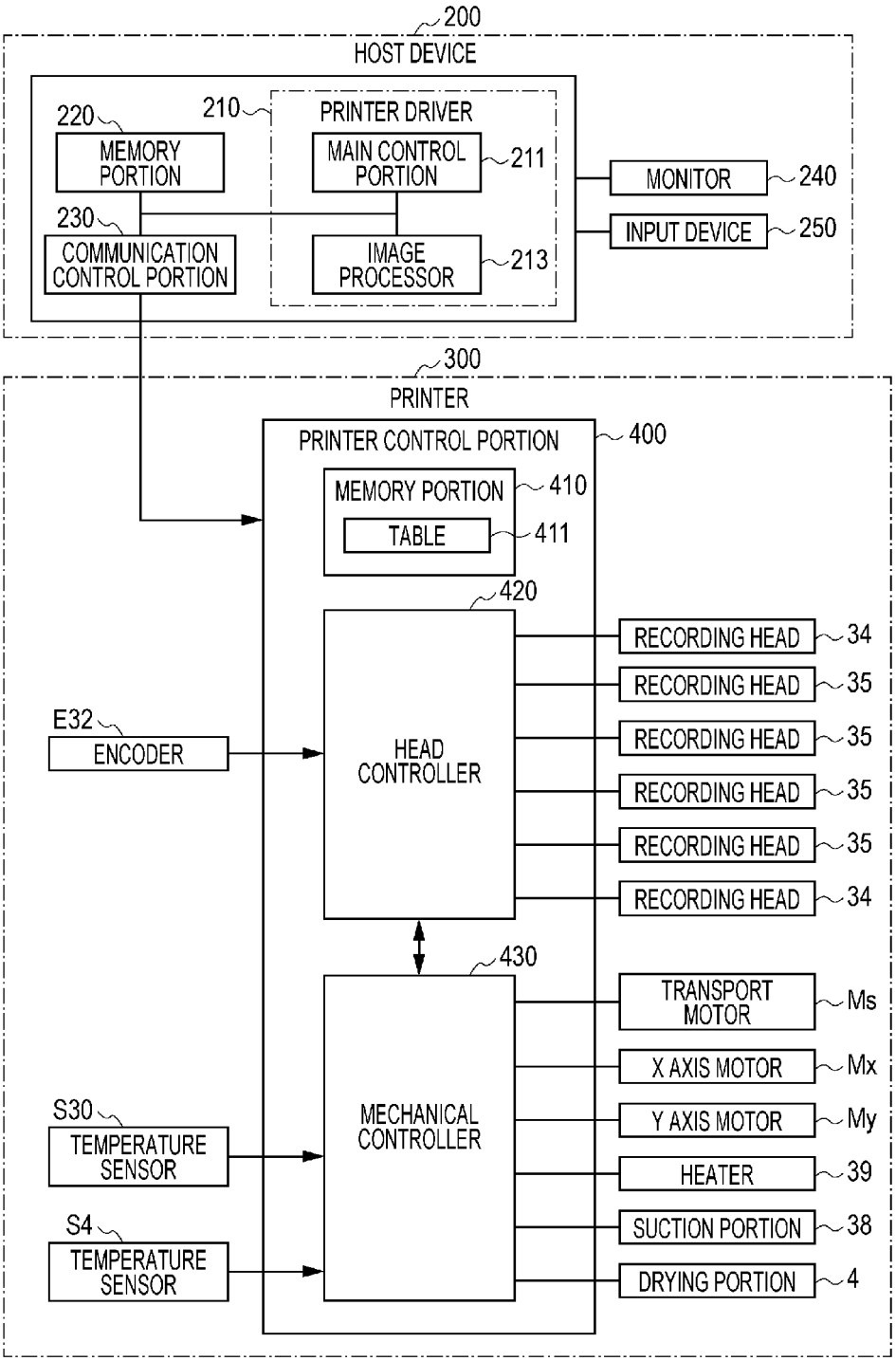
FIG. 3 is a block diagram schematically illustrating an electrical configuration in which a printing apparatus in FIG. 1 is provided.

Above is a summary of a mechanical configuration that the printing system 100 is provided with. Subsequently, in addition to FIG. 1 described above, FIG. 3 describes an electrical configuration which is provided with the printing system 100 in FIG. 1. Here, FIG. 3 is a block diagram schematically illustrating the electrical configuration in which a printing apparatus in FIG. 1 is provided.

As described above, the printing system 100 is provided with the host device 200 that controls the printer 300. The host device 200 is configured, for example, by a personal computer, and is provided with a printer driver 210 that controls operation of the printer 300. That is, the printer driver 210 is constructed by a central processing unit (CPU), which is provided in the host device 200, executing a program for the printer driver 210. Furthermore, the host device 200 is provided with a memory portion 220 that is configured by a random access memory (RAM), a hard disk drive (HDD), or the like, and a communication control portion 230 that governs a communication function of the printer 300.

In addition, the host device 200 is provided with a monitor 240 that is configured by a liquid crystal display and the like and an input device 250 that is configured by a keyboard, mouse, or the like as an interface with an operator. That is, the monitor 240 and the input device 250 may be integrally configured by a touch panel display. A menu screen in another image that is a target for printing is displayed on the monitor 240. Accordingly, the operator is able to set various printing conditions such as a type of the sheet S, a size of the sheet S, printing quality, and a version number by opening a printing setting screen from the menu screen by operating the input device 250 while confirming the monitor 240.

The printer driver 210 has a main control portion 211, and the main control portion 211 controls display of the monitor 240 and an input process from the input device 250. In detail, the main control portion 211 displays various screens such as the menu screen or the printing setting screen on the monitor 240 and performs a process according to content that is input from the input device 250 on various screens. Thereby, the main control portion 211 generates a necessary control signal for controlling the printer 300 according to input from the operator.

Furthermore, the printer driver 210 has an image processor 213 that executes image processing with respect to image data that is received from the external device. The image processor 213 generates printing data that is necessary for driving the recording heads 35 according to the image data. In detail, the image processor 213 executes color conversion processing and halftone processing with respect to the image data. That is, the image data that is received from the external device is configured by three color components of R, G, and B, and a pixel value of each pixel is represented by multiple tones (for example, 256 tones). Therefore, the image processor 213 executes on the image data color conversion processing that converts each component of R, G, and B on a plurality of color components (for example, Y, M, C, and K) that are able to be printed by the printer 300. Then, the image processor 213 executes halftone processing using a dither matrix with respect to the image data after color conversion processing. By half tone processing, the image data that represents the pixel value of each pixel in multiple tones is converted to printing data that is binary data which indicates presence or absence of discharge of ink dots on each pixel.

Then, the control signal that is generated by the main control portion 211 or the printing data that is generated by the image processor 213 are transferred to a printer control portion 400 that is provided within the main body casing 1 of the printer 300 via the communication control portion 230. The communication control portion 230 is able to perform two-way serial communication with the printer control portion 400, the control signal or the printing data is transferred to the printer control portion 400, and a response signal thereof is received from the printer control portion 400 and transmitted to the main control portion 211.

The printer control portion 400 is provided with a memory portion 410, a head controller 420, and a mechanical controller 430. The memory portion 410 is configured by an HDD and the like, and stores a program that is necessary to execute the printing process or the control signal and the printing data that are transmitted from the host device 200.

The head controller 420 controls the recording heads 34 and 35 based on the control signal or the printing data that is transmitted from the printer driver 210. In detail, the head controller 420 controls discharge of the reaction liquid of the recording heads 34 such that the reaction liquid of an appropriate amount is given at a predetermined position on the sheet S. In addition, the head controller 420 lands ink at a position that is indicated by the printing data by controlling discharge of ink from the recording heads 35 based on the printing data.

At this time, a discharge timing from the recording heads 34 and 35 is controlled based on movement of the carriage 32 in the X axis direction. That is, a linear encoder E32 that detects the position of the carriage 32 in the X axis direction is provided inside the printing chamber 3. Then, the head controller 420 discharges the reaction liquid or ink from the recording heads 34 and 35 at a timing according to movement of the carriage 32 in the X axis direction by referencing output of the linear encoder E32.

That is, in the embodiment, an amount (duty) per unit area of the reaction liquid that is discharged from the recording heads 34 as will be described later onto the sheet S is controlled according to infiltration into the sheet S. In detail, a table 411 that indicates duty of the reaction liquid according to infiltration into various sheets S is stored in the memory portion 410 by associating the type of sheet S and the duty of the reaction liquid. Then, the head controller 420 determines duty of the reaction liquid based on the table 411 and a result of sheet information, which indicates the type of sheet S that is the target for printing, is extracted from the information signal, and discharges the reaction liquid to the recording heads 34 at the duty.

Meanwhile, the mechanical controller 430 mainly controls intermittent transport of the sheet S or driving of the carriage 32. In detail, the mechanical controller 430 executes intermittent transport of the sheet S by controlling a transport motor Ms which drives a sheet transport system that is configured by the feeding portion 2, the rollers 71 to 77, and the winding portion 5. In addition, the mechanical controller 430 executes movement in the X axis direction for main scanning in the carriage 32 by controlling the X axis motor Mx and executes movement in the Y axis direction for sub-scanning in the carriage 32 by controlling the Y axis motor My.

Furthermore, the mechanical controller 430 is able to execute various control other than the control described above for the printing process. For example, the mechanical controller 430 executes temperature control such as carrying out feedback control on the heater 39 based on output of a temperature sensor S30 which detects temperature on the upper surface of the platen 30 and carrying out feedback control on the drying portion 4 based on output of a temperature sensor S4 which detects temperature inside the drying portion 4.

Above is a summary of a mechanical configuration that the printing system in FIG. 1 is provided with. As described above, in the printing process that is executed by the printer 300, ink is fixed to the front surface of the sheet S by coagulating by the action of the reaction liquid by discharging ink from the recording heads 35 onto the front surface of the sheet S after discharging the reaction liquid from the recording heads 34 onto the front surface of the sheet S. In the printing process in this manner, time lag occurs from the reaction liquid being landed in a range that is the sheet S until ink lands in the range. Then, during the timing, the reaction liquid that is landed on the front surface of the sheet S infiltrates inside the sheet S. At this time, it is desirable to control the printing process such that the reaction liquid of an appropriate amount remains on the front surface of the sheet S when ink is discharged on the front surface of the sheet S. Subsequently, these points will be described.

Figure 4:
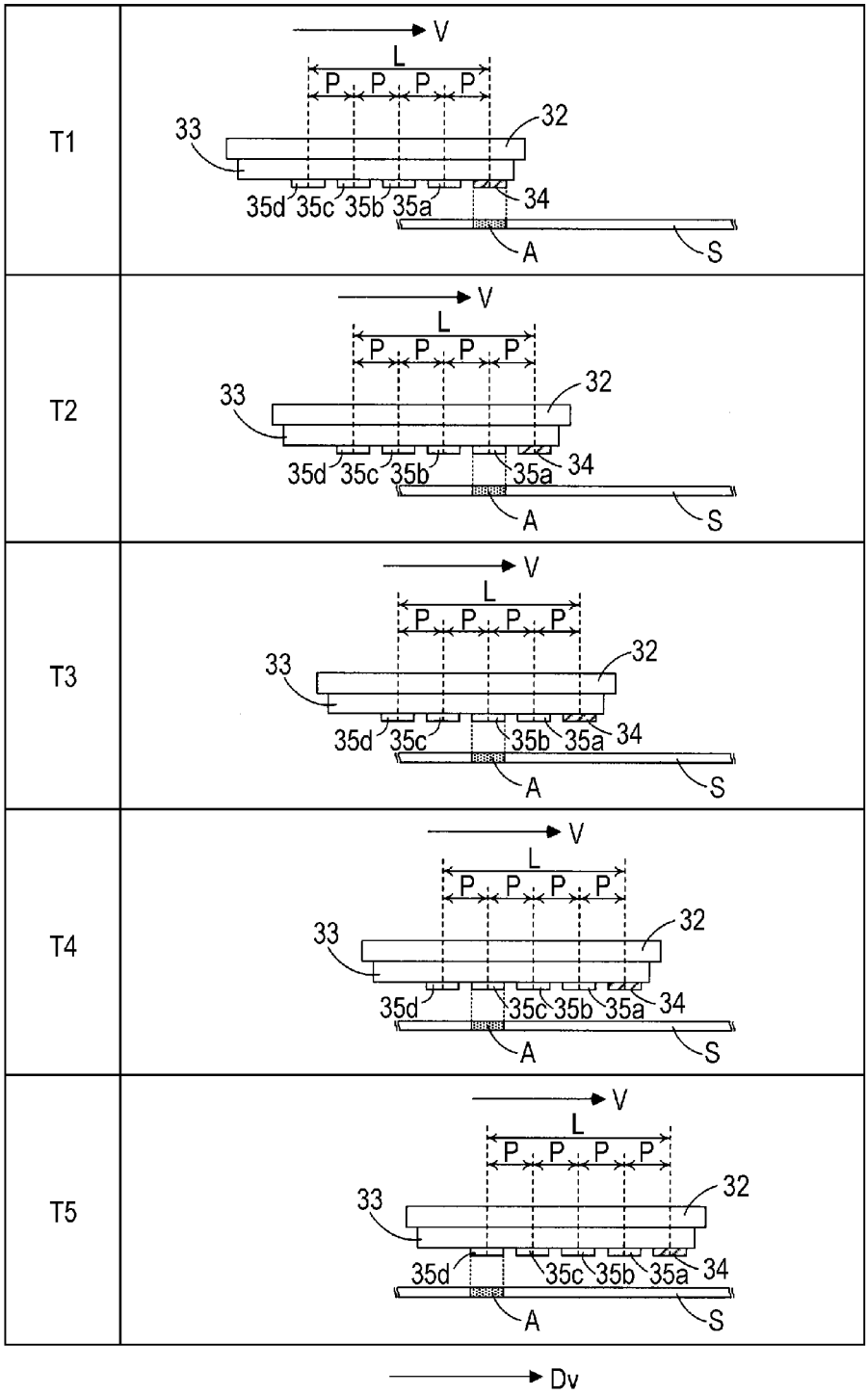
FIG. 4 is a diagram illustrating an operation that is executed by a printing process.

FIG. 4 is a diagram schematically illustrating an operation that is executed by a printing process. Here, different reference numerals 35*a* to 35*d* are given to distinguish the four recording heads 35. Note that, in each main scan that is executed by the printing process, illustration of the recording head 34 is omitted since the recording head 34 at the most upstream (that is, the end) of the carriage 32 in a movement direction Dv does not perform discharge of the reaction liquid.

As shown in FIG. 4, the recording heads 34 and 35*a* to 35*d* are lined up in order from the downstream side in the movement direction Dv at an equal pitch P parallel to the movement direction Dv, and a distance L between the recording heads 34 and the recording head 35*d* is I×P. Here, "I" is a number (=4) of the recording heads 35, and it is possible to obtain the pitch P or the distance L as a length in the movement direction Dv between a geometric center of gravity of the nozzle N in a disposition range using, for example, each recording head 34 and 35. Then, in the printing process, the reaction liquid or ink is discharged in order onto the sheet S while moving the recording heads 34 and 35*a* to 35*d* in the movement direction Dv at a velocity V.

Here in particular, description is made using an example of an operation in which the reaction liquid and ink are discharged in a predetermined range A of the sheet S. In the example, ink is discharged in the predetermined range A in which the recording heads 34 discharge the reaction liquid while each recording head 35*a* to 35*d* that is provided on the upstream side of the movement direction Dv due to the recording heads 34 follows the recording heads 34.

That is, at a time T1, the reaction liquid is discharged in the range A by the recording heads 34 reaching directly above the range A. Subsequently, out of the recording heads 35*a* to 35*d*, the recording head 35*a* at the most downstream (that is, the end) in the movement direction Dv discharges ink in the range A by reaching directly above the range A at a time T2. Subsequently, at respective times T3 and T4, ink is discharged in the range A by the recording heads 35*b* and 35*c* reaching directly above the range A. Finally, out of the recording heads 35*a* to 35*d*, the recording head 35*d* at the most upstream (that is, the end) in the movement direction Dv discharges ink in the range A by reaching directly above the range A at a time T5.

At this time, since the reaction liquid that is applied to the front surface of the sheet S at time T1 infiltrates into the sheet S accompanying the elapsing of time, the amount of the reaction liquid that remains on the front surface of the sheet S reduces accompanying the elapsing of the times T2 to T5. In contrast to this, since image defects are generated if the amount of the reaction liquid that remains on the front surface of the sheet S is too much or too little, an appropriate range exists at a time lag from the reaction liquid being discharged in the range A until ink is discharged. However, times T2 to T5 at which the respective recording heads 35*a* to 35*d* discharge ink are different, therefore it is necessary to consider the following points.

That is, the reaction liquid that remains on the front surface of the range A at time T5 at which the recording head 35*d* discharges ink is little with respect to a great amount of the reaction liquid that remains on the front surface of the range A at the time T2 at which the recording head 35*a* discharges ink. At this time, when residual reaction liquid is too great at time T2, there is a concern that blurring or an indentation of an end occurs on the image using ink that is discharged from the recording head 35*a*, and meanwhile when residual reaction liquid is too little at time T5, bleeding occurs in the image using ink that is discharged from the recording head 35*d*.

Therefore, when a minimum time of the appropriate range of the time lag from discharge of the reaction liquid until discharge of ink is Tn and a maximum time is Tx, an image defect is generated due to residual reaction liquid being too great when the time lag up to times T1 to T2 is less than the time Tn, and the image defect is generated due to residual reaction liquid being too little when the time lag up to times T1 to T5 is longer than the time Tx. Accordingly, it is desired that time lag up to times T1 to T2 is the time Tn or more, and it is desired that time lag up to times T1 to T5 are the time Tx or less.

Here, time lag of the times T1 to T2 is given as P/V with respect to the pitch P, the velocity V and the distance L, and the time lag from times T1 to T5 is given as L/V. Accordingly, the following conditional formulas are obtained $$P/V \geq Tn \qquad \text{Formula 1}$$

$$Tx \geq L/V \qquad \text{Formula 2}$$

and solving the formulas with respect to the velocity V the following conditional formula is obtained $$P/Tn \geq V \geq L/Tx \qquad \text{Formula 3.}$$

Accordingly, the minimum time Tn and the maximum time Tx may be adjusted to satisfy Formula 3.

Here, as described above, the minimum time Tn and the maximum time Tx are times that specify the appropriate range in which it is possible to suppress generation of image defects, and in other words, the time range is indicated in which the remaining amount of the reaction liquid on the front surface of the sheet S is an appropriate amount. At this time, the remaining amount of the reaction liquid is dependent on an initial liquid amount (liquid amount per unit area) of the reaction liquid that is applied to the front surface of the sheet S using the recording heads 34 and infiltration into the sheet S. Accordingly, the minimum time Tn and the maximum time Tx are values that are determined using the liquid amount per unit area that is applied by the recording heads 34 to the sheet S and the infiltration into the sheet S.

Figure 5:
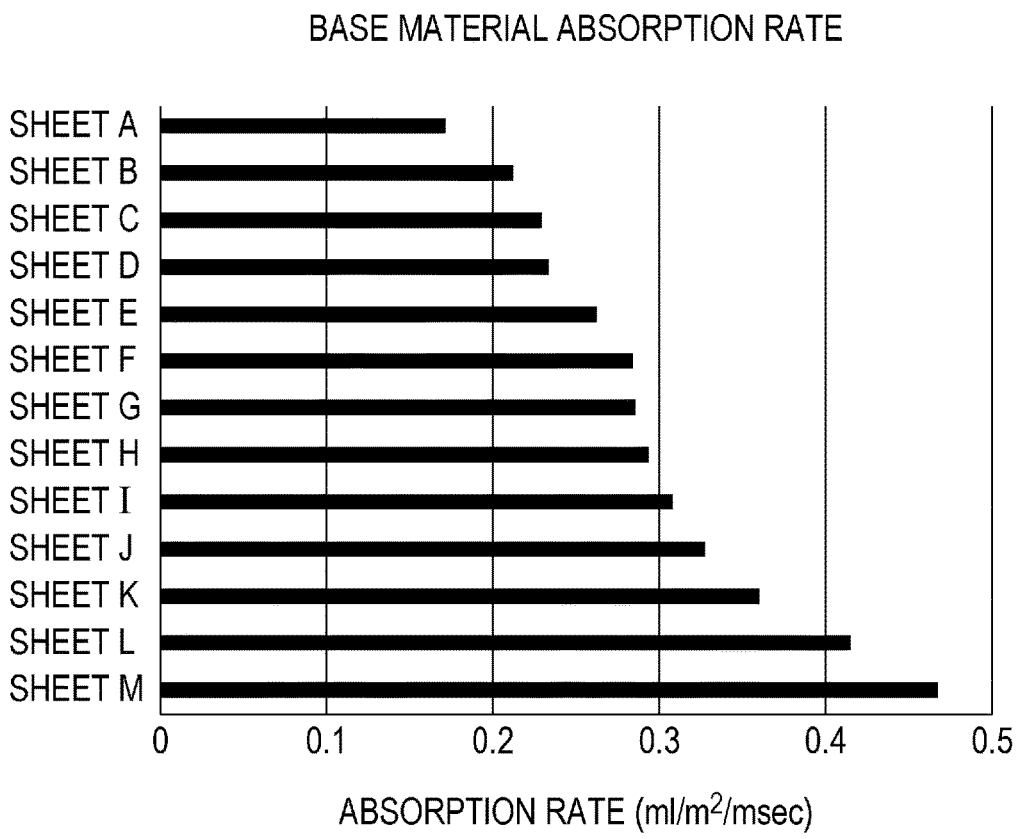
FIG. 5 is a diagram illustrating difference of infiltration according to a type of sheet.

However, as shown in FIG. 5, infiltration into the sheet S is different according to the type of sheet S. Here, FIG. 5 is a diagram illustrating difference of infiltration according to the type of sheet. The type of sheet S (base material) is indicated on the vertical axis in the diagram, and infiltration (absorption rate) of the sheet S is indicated in the horizontal axis. That is, it is possible to use the Bristow method using a KM350D dynamic scanning liquid absorptiometer of Kyowa Seiko Co., Ltd. in measurement of the infiltration.

Accordingly, since the minimum time Tn and the maximum time Tx are set as appropriate values, it is necessary to determine the amount per unit area of the reaction liquid that is applied to the sheet S according to the infiltration into the sheet S. Then, the liquid amount is able to be determined based on, for example, a result in which an experiment is carried out in advance as will be described.

FIG. 6 is a diagram illustrating the result in which an experiment is carried out on the relationship between the time from the reaction liquid being discharged until ink is discharged and generation of image defects. In the diagram, an experiment that confirms generation of image defects while an elapsed time T(s) from the reaction liquid being discharged until ink is discharged and the amount per unit area of the reaction liquid, that is, duty (%) are changed is indicated by a result that is performed on three types of sheets S (sheet A, sheet G, and sheet M) that have different infiltration. In particular, in the diagram, a first stage table has a result in which generation of image defects that are caused by the reaction liquid being too little is confirmed, a second stage table has a result in which generation of image defects that are caused by the reaction liquid being too great is confirmed, and a third stage table has a result in which the first stage table and the second stage table are combined. Ink that is used in the experiment is dye ink with a surface tension of 27.9 mN/m with viscosity of 3.2 cps, viewing the formed image, an experiment result where there are no image defects is "○", an experiment result where image defects are generated in a permissible range is "Δ", and an experiment result where image defects are generated exceeding the permissible range is "x".

As shown in the first stage table, image defects (bleeding) that are caused by the reaction liquid being too little remarkably appears in a case where the sheet S with high infiltration is used and yet duty is small. Meanwhile, as shown in the second stage table, image defects (blurring or an indentation of an end) that are caused by the reaction liquid being too great remarkably appears in a case where the sheet S with low infiltration is used and yet duty is large. As a result, a condition in which it is possible to form an image with suitable image quality by suppressing generation of any image defect is a condition which is equivalent to the part of the third stage table that is enclosed in a thick frame.

Thereby, in a case where the sheet S of a sheet A that has minimal infiltration is used, it is possible to set the minimum time Tn to the maximum time Tx to 0.7 to 1.4 seconds by setting the duty (ratio) of the reaction liquid to 40%. In a case where the sheet S of a sheet G that has medium degree of infiltration is used, it is possible to set the minimum time Tn to the maximum time Tx to 0.35 to 1.4 seconds by setting the duty of the reaction liquid to 40%. In addition, in a case where the sheet S of a sheet M that has maximum infiltration is used, it is possible to set the minimum time Tn to the maximum time Tx to 0.35 to 1.4 seconds by setting the duty of the reaction liquid to 80%. In this manner, it is possible to widely secure the minimum time Tn to the maximum time Tx and it is possible to reliably fulfill Formula 3 above by adjusting the duty of the reaction liquid according to the infiltration into the sheet S.

Figure 7:
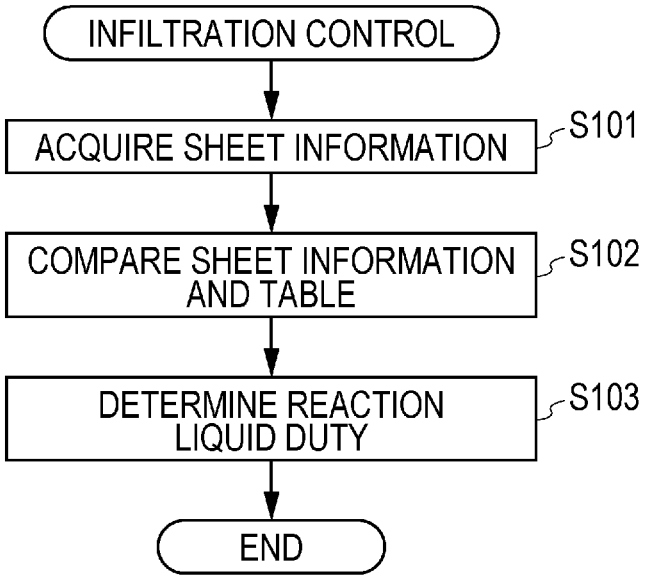
FIG. 7 is a flow chart illustrating a first example of infiltration control of the reaction liquid.

Therefore, the printer control portion 400 makes the amount of the reaction liquid that remains on the front surface of the sheet S proper by executing infiltration control of the reaction liquid as shown in FIG. 7. FIG. 7 is a flow chart illustrating a first example of infiltration control of the reaction liquid. In the infiltration control, sheet information that illustrates the type of sheet S from a control signal which is received from the host device 200 is extracted (step S101), and the type of sheet S that is indicated by the sheet information is compared with the table 411 (step S102). Here, as described above, table 411 indicates association of the type of sheet S and duty of the reaction liquid, and indicates a greater duty the higher the reaction liquid of the sheet S. Then, discharge of the reaction liquid is determined at a duty corresponding to the type of the sheet S (step S103). Due to this, in the printing process, the reaction liquid is discharged onto the sheet S at the duty which is determined according to the infiltration into the sheet S.

In this manner, in the embodiment, the amount per unit area of the reaction liquid that is applied to the sheet S is adjusted according to infiltration into the sheet S. Due to this, it is possible to adjust the minimum time Tn and the maximum time Tx so as to satisfy Formula 3 above, and as a result, it is possible for the reaction liquid of an appropriate amount to remain on the front surface of the sheet S when ink is applied to the sheet S.

In detail, since the higher the infiltration into the sheet S, the faster the reaction liquid that is applied to the sheet S infiltrates inside from the front surface of the sheet S, reduction of the reaction liquid that remains on the front surface of the sheet S speeds up. Therefore, the head controller 420 raises the amount per unit area of the reaction liquid that is applied to the sheet S from the recording heads 34 the higher the infiltration into the sheet S. Due to this, it is possible for the reaction liquid of an appropriate amount to remain on the front surface of the sheet S when ink is applied to the sheet S.

Note that, Formula 3 above that is desired to satisfy the appropriate range of time lag from discharge of the reaction liquid until discharge of ink is able to indicate and capture a condition with respect to movement velocity V. Therefore, in the second example of the infiltration control of subsequently illustrated reaction liquid, infiltration control of the reaction liquid illustrated in FIG. 8 is executed by the printer control portion 400.

Figure 8:
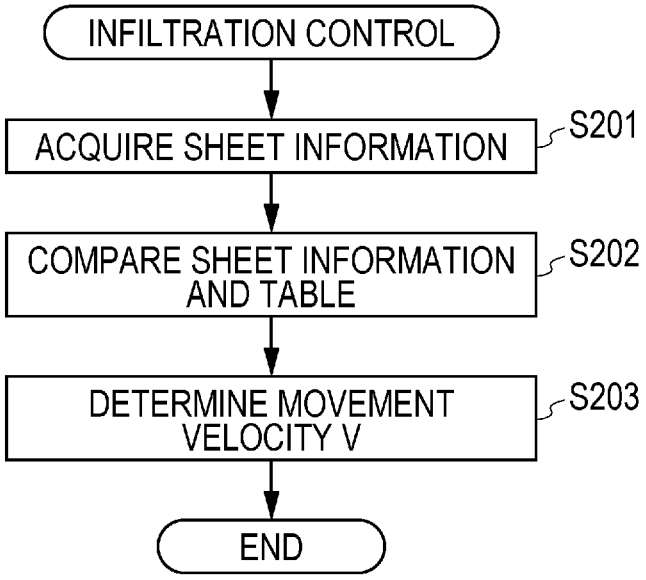
FIG. 8 is a flow chart illustrating a second example of infiltration control of the reaction liquid.

FIG. 8 is a flow chart illustrating a second example of infiltration control of the reaction liquid. Even in the second example, sheet information is acquired and the type of sheet S is confirmed in the same manner as step S101 of the first example (step S201). Then, the type of sheet S that is indicated by the sheet information is compared with the table 411 (step S202). However, differently from the first example, the table 411 of the second example illustrates the movement velocity V according to infiltration into various sheets S by associating the type of sheet S and the movement velocity V. That is, the movement velocity V determines an upper limit value (=P/Tn) and a lower limit value (L/Tx) using Formula 3. At this time, the higher the infiltration into the sheet S, the shorter the minimum time Tn and the maximum time Tx become, and as a result, the upper limit value and the lower limit value of the movement velocity V become large. In contrast, the lower the infiltration into the sheet S, the minimum time Tn and the maximum time Tx become longer, and as a result, the upper limit value and the lower limit value of the movement velocity V become small. Therefore, in the table 411, the movement velocity V increases the higher the infiltration into the sheet S. Then, in step S203, the movement velocity V is determined according to the type of the sheet S based on the table 411.

In this manner, in the embodiment, the reaction liquid is discharged onto the sheet S while the recording heads 34 move in the movement direction Dv and ink is discharged onto the sheet S while the recording heads 35 move in a form of following the recording heads 34. Due to this, ink is applied to the sheet S onto which the reaction liquid is applied. At this time, a time is changed from the reaction liquid being applied to the sheet S until ink is applied according to the velocity V at which the recording heads 34 and the recording heads 35 move, and the amount of the reaction liquid that remains on the sheet S is also changed when ink is applied. Therefore, in the embodiment, the movement velocity V of the recording heads 34 and the recording heads 35 are adjusted according to the infiltration into the sheet S. As a result, it is possible for the reaction liquid of the appropriate amount to remain on the front surface of the sheet S when ink is applied to the sheet S.

In detail, since the higher the infiltration into the sheet S, the faster the reaction liquid that is applied to the sheet S infiltrates inside from the front surface of the sheet S, reduction of the reaction liquid that remains on the front surface of the sheet S speeds up. Therefore, the mechanical controller 430 raises the movement velocity V at which the recording heads 34 and the recording heads 35 are relatively moved with respect to the sheet S the higher the infiltration into the sheet S. Due to this, it is possible for the reaction liquid of an appropriate amount to remain on the front surface of the sheet S when ink is applied to the sheet S.

Note that, the printer 300 described above is provided with the heater 39 that carries out primary heating on the sheet S on the platen 30. Accordingly, it is also possible to adjust the amount of the reaction liquid that remains on the front surface of the sheet S by raising and lowering the temperature of the platen 30 due to control of the output of the heater 39. Therefore, in the third example of the infiltration control of subsequently illustrated reaction liquid, infiltration of the reaction liquid illustrated in FIG. 9 is executed by the printer control portion 400.

Figure 9:
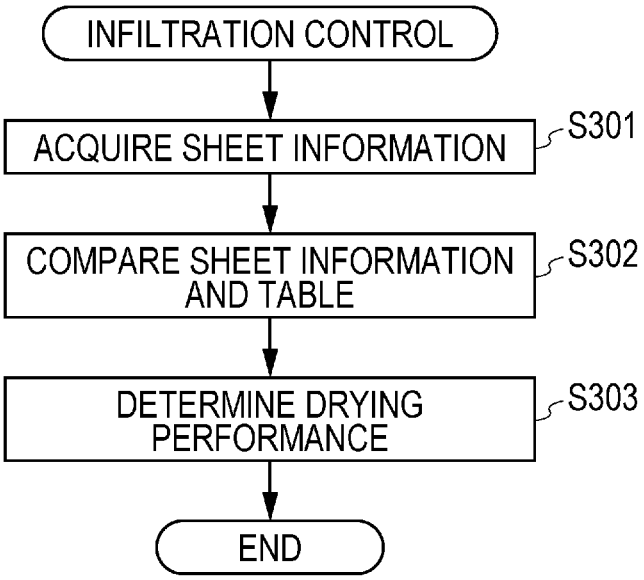
FIG. 9 is a flow chart illustrating a third example of infiltration control of the reaction liquid.

FIG. 9 is a flow chart illustrating a third example of infiltration control of the reaction liquid. Even in the third example, sheet information is acquired and the type of sheet S is confirmed in the same manner as step S101 of the first example (step S301). Then, the type of sheet S that is indicated by the sheet information is compared with the table 411 (step S302). However, differently from the first example, the table 411 of the third example illustrates the temperature of the platen 30 according to the infiltration into various sheets S by associating the type of sheet S and the temperature of the platen 30. In detail, in the table 411, the temperature of the platen 30 is lowered the higher the infiltration into the sheet S. Then, in step S303, the temperature of the platen 30 is determined according to the type of the sheet S based on the table 411.

In this manner, in the embodiment, the sheet S to which the reaction liquid is applied is dried by the heater 39 from the reaction liquid being applied by the recording heads 34 until ink is applied by the recording heads 35. Then, the mechanical controller 430 adjusts drying performance of the heater 39 (that is, output of the heater 39, and thus the temperature of the platen 30) according to the infiltration into the sheet S. As a result, it is possible for the reaction liquid of the appropriate amount to remain on the front surface of the sheet S when ink is applied to the sheet S.

In detail, since the higher the infiltration into the sheet S, the faster the reaction liquid that is applied to the sheet S infiltrates inside from the front surface of the sheet S, reduction of the reaction liquid that remains on the front surface of the sheet S speeds up. Therefore, the mechanical controller 430 lowers the drying performance of the heater 39 is lowered the higher the infiltration into the sheet S. Due to this, it is possible for the reaction liquid of an appropriate amount to remain on the front surface of the sheet S when ink is applied to the sheet S.

As described above, in the embodiment, the printer 300 is equivalent to an example of the "image forming apparatus" of the invention, the recording head 34 is equivalent to an example of the "reaction liquid application portion" of the invention, the recording heads 35 or the respective recording heads 35*a* to 35*d* are equivalent to an example of the "ink application portion" of the invention, the printer control portion 400 is equivalent to an example of the "control portion" of the invention, the X axis motor Mx is equivalent to an example of the "driving portion" of the invention, the movement direction Dv is equivalent to an example of the "predetermined direction" of the invention, the carriage 32 is equivalent to an example of the "carriage" of the invention, the heater 39 is equivalent to an example of the "drying portion" of the invention, and the sheet S is equivalent to an example of the "recording medium" of the invention.

Here, the invention is not limited to the embodiments described above, and it is possible to add various modifications with regard to the above description without deviating from the gist of the invention. For example, in the embodiment, control (first example) that changes duty of the reaction liquid, control (second example) that changes movement velocity V of the recording heads 34 and 35, and control (third example) that changes the drying performance of the heater 39 are individually indicated according to the infiltration into the sheet S. However, the controls are also able to be appropriately combined.

For example, according to the first example, the movement velocity V of the recording heads 34 and 35 may be further adjusted after the duty of the reaction liquid is adjusted according to the reaction liquid of the sheet S. In detail, when the duty of the reaction liquid is determined, an upper limit value (=P/Tn) and a lower limit value (L/Tx) of the movement velocity V that are specified in Formula 3 are determined. At this time, the higher the infiltration into the sheet S, the shorter the minimum time Tn and the maximum time Tx become, and the upper limit value and the lower limit value of the movement velocity V become large. Therefore, the movement velocity V may be adjusted to a center value of the upper limit value and the lower limit value. Alternatively, in a case where the movement velocity V during setting is outside from the predetermined range in which the center value is set as the center, the movement velocity V may be adjusted so as to fall in the predetermined range.

Alternatively, the drying performance of the heater 39 may be further adjusted after the duty of the reaction liquid is adjusted according to the reaction liquid of the sheet S. That is, it is possible to modify the minimum time Tn and the maximum time Tx, in other words, it is possible to adjust the upper limit value and the lower limit value of the movement velocity V by adjusting the drying performance of the heater 39. Therefore, in a case where the movement velocity V during setting is outside the predetermined value or more with respect to the center value of the upper limit value and the lower limit value of the movement velocity V that are determined according to the duty of the reaction liquid after adjustment, the movement velocity V may be controlled to come close to the center value by adjusting the drying performance of the heater 39.

In addition, in the embodiment, in a state in which the sheet S is stopped, the recording heads 34 and the recording heads 35 are moved at the movement velocity V. However, as described in, for example, JP A-2015-134460, it is also possible to configure the printer 300 such that the recording medium is transported while the head which discharges the reaction liquid and the head which discharges ink are fixed. With this configuration, the printing process is executed by discharging the reaction liquid or ink from the recording heads 34 and 35 while transporting the sheet S in the transport direction. At this time, it is possible to execute control in the same manner as in the second example of infiltration control of the reaction liquid described above by adjusting the movement velocity of the sheet S according to the infiltration into the sheet S.

In addition, in the embodiment, the recording heads 34 and 35*a* to 35*d* are disposed lined up in order from the downstream side in the movement direction Dv at an equal pitch P parallel to the movement direction Dv, but are not limited thereto. For example, in a case where a target value of a necessary printing velocity is determined in advance, a solution may not be obtained for the pitch between recording heads to satisfy Formula 3. Therefore, the pitch between the recording heads may be individually set. However, it is preferable that the pitch between recording heads between the recording heads 35*a* to 35*d* that discharge ink that contains color material is set to an equal pitch at which it is considered to improve ease of control or image quality. Therefore, the pitch between the recording heads between the recording heads 34 and 35*a* may be different to the pitch between the recording heads between the recording heads 35*a* to 35*d*. At this time, in order to satisfy Formula 3, the pitch between the recording heads between the recording heads 34 and 35*a* may be larger than the pitch between each recording head between the recording heads 35*a* to 35*d*. Furthermore, a pitch adjustment portion is provided between the recording heads in which it is possible to adjust the pitch between the recording heads between the recording heads 34 and 35*a* based on the control signal from the printer control portion 400, in which the pitch between the recording heads between the recording heads 34 and 35*a* may be adjusted to satisfy Formula 3 by controlling the pitch adjustment portion between the recording heads based on printing velocity, data in table 411 which corresponds to the type of the sheet S that indicates sheet information (at least one of the duty of the reaction liquid, drying performance of the heater 39, and the minimum time Tn and the maximum time Tx), and information such as the pitch between each recording head between the recording heads 35*a* to 35*d*.

In addition, in the embodiment, the image per one frame is printed by alternately executing main scanning a plurality of times with sub-scanning. However, it is not a problem if the printer 300 is configured to print the image per one frame in main scanning of one time. In this case, the recording heads 34 and 35 are configured such that the plurality of nozzles N are lined up at an equal pitch in the Y axis direction according to resolution that is desired in the image, and it is possible to execute printing per one frame by discharging the reaction liquid and ink from each nozzle N while moving the recording heads 34 and 35 in the X axis direction.

This application claims priority under 35 U.S.C. § 119 to Japanese Patent Application No. 2016-033923, filed Feb. 25, 2016. The entire disclosure of Japanese Patent Application No. 2016-033923 is hereby incorporated herein by reference.

What is claimed is:

1. An image forming apparatus comprising:

a reaction liquid application portion that applies reaction liquid to a recording medium;

an ink application portion that applies ink which includes a color material that is coagulated using the reaction liquid onto the recording medium onto which the reaction liquid is applied;

a control portion that adjusts an amount per unit area of the reaction liquid that is applied to the recording medium from the reaction liquid application portion according to infiltration into the recording medium; and a driving portion that relatively moves the reaction liquid application portion and the ink application portion in a predetermined direction with respect to the recording medium, wherein the reaction liquid application portion applies the reaction liquid to the recording medium by discharging the reaction liquid while relatively moving in the predetermined direction with respect to the recording medium, the ink application portion applies the ink onto the recording medium on which the reaction liquid is applied by the reaction liquid application portion by discharging the ink while relatively moving in a predetermined direction with respect to the recording medium at an upstream side in the predetermined direction with respect to the reaction liquid application portion, and the control portion adjusts velocity at which the reaction liquid application portion and the ink application portion are relatively moved with respect to the recording medium according to the infiltration into the recording medium.

2. The image forming apparatus according to claim 1, wherein the control portion raises the amount per unit area of the reaction liquid that is applied to the recording medium from the reaction liquid application portion the higher the infiltration into the recording medium.

3. The image forming apparatus according to claim 1, wherein the control portion increases velocity at which the reaction liquid application portion and the ink application portion are relatively moved with respect to the recording medium the higher the infiltration into the recording medium.

4. The image forming apparatus according to claim 1, wherein the driving portion moves a carriage that holds the reaction liquid application portion and the ink application portion in the predetermined direction, and the control portion adjusts velocity at which the carriage is moved in a predetermined direction according to infiltration into the recording medium.

5. The image forming apparatus according to claim 1, wherein the driving portion moves the recording medium in a reverse direction to the predetermined direction, and the control portion adjusts velocity at which the recording medium is moved in the reverse direction according to infiltration into the recording medium.

6. The image forming apparatus according to claim 1, further comprising:

a drying portion that dries the recording medium on which the reaction liquid is applied from the reaction liquid being applied by the reaction liquid application portion until the ink is applied by the ink application portion, wherein the control portion adjusts drying performance of the drying portion according to the infiltration into the recording medium.

7. The image forming apparatus according to claim 6, wherein the control portion lowers the drying performance of the drying portion the higher the infiltration into the recording medium.

8. An image forming method comprising:

applying reaction liquid to a recording medium using a reaction liquid application portion while using a driving portion to relatively move the reaction liquid application portion and the ink application portion in a predetermined direction with respect to the recording medium; and applying ink to the recording medium using the reaction liquid application portion, and while relatively moving the reaction liquid application portion and the ink application portion in the predetermined direction with respect to the recording medium, the ink including a color material that is coagulated using the reaction liquid onto the recording medium onto which the reaction liquid is applied, wherein an amount per unit area of the reaction liquid that is applied to the recording medium is adjusted according to infiltration into the recording medium by adjusting a velocity at which the reaction liquid application portion and the ink application portion are relatively moved with respect to the recording medium according to the infiltration into the recording medium.

* * * * *